US007607630B2

(12) United States Patent
Jung et al.

(10) Patent No.: US 7,607,630 B2
(45) Date of Patent: Oct. 27, 2009

(54) STORAGE CONTAINER WITH RETRACTABLE STANDS

(76) Inventors: Shane F. Jung, 21426 Marjorie Ave., Torrance, CA (US) 90503; Shu F. Jung, 21426 Marjorie Ave., Torrance, CA (US) 90503; Jason Jung, 21426 Marjorie Ave., Torrance, CA (US) 90503; Kevin H. Jung, 21426 Marjorie Ave., Torrance, CA (US) 90503

( * ) Notice: Subject to any disclaimer, the term of this patent is extended or adjusted under 35 U.S.C. 154(b) by 54 days.

(21) Appl. No.: 11/870,375

(22) Filed: Oct. 10, 2007

(65) Prior Publication Data

US 2009/0095762 A1 Apr. 16, 2009

(51) Int. Cl.
*F16M 11/32* (2006.01)

(52) U.S. Cl. ..... 248/440.1; 248/163.1; 248/166; 248/457; 190/18 R; 206/45.2

(58) Field of Classification Search ..... 248/457, 248/440.1, 173, 96, 163.1; 206/45.2, 166, 206/127–144; 190/18 R; 108/117, 116; 220/628, 629, 631

See application file for complete search history.

(56) References Cited

U.S. PATENT DOCUMENTS

| | | | | | |
|---|---|---|---|---|---|
| 2,663,391 | A * | 12/1953 | Kuhns | 190/12 R |
| 4,049,091 | A * | 9/1977 | Chubb | 190/18 R |
| 4,949,502 | A * | 8/1990 | Anderson | 47/40.5 |
| 7,137,608 | B2 * | 11/2006 | Willey | 248/519 |
| 7,341,164 | B2 * | 3/2008 | Barquist et al. | 220/629 |
| 7,350,671 | B2 * | 4/2008 | Mika et al. | 222/129 |
| 2002/0134697 | A1 * | 9/2002 | Barnett | 206/320 |

* cited by examiner

*Primary Examiner*—Amy J. Sterling
(74) *Attorney, Agent, or Firm*—Pai Patent & Trademark Law Firm; Chao-Chang David Pai

(57) ABSTRACT

A storage container with retractable stands has a body and two stand assemblies. The body has a front surface, a rear surface and multiple slots. The slots are formed in the front and rear surfaces. Each stand assembly has multiple props. Each prop is mounted pivotally in a corresponding slot. The props are pivoted to stand on the ground to stand the storage container off the ground for increased convenience. When the props are held in the slots, the props are completely received in the slots to avoid additional storage volume.

17 Claims, 14 Drawing Sheets

STORAGE CONTAINER WITH RETRACTABLE STANDS

BACKGROUND OF THE INVENTION

1. Field of the Invention

The present invention relates to a storage container, especially to a storage container with retractable stands.

2. Description of the Prior Arts

A conventional storage container can be used as a suitcase to pack things into when traveling or moving or for carrying sports equipment, such as tennis balls. The conventional storage container has a top, a bottom surface, a height and a cover. The height is equal to the distance between the top and the bottom surface. The cover is mounted pivotally in the top. When a person wants to remove items from the conventional storage container, the bottom surface is placed on the ground to allow the person to open the cover. However, the height of the conventional storage container is shorter than a person. Therefore, the person has to bend over or squat down to open the cover and remove the items from the conventional storage container, this is especially inconvenient when the person has to repeatedly remove items from the conventional storage container. The person may place the conventional storage container on a table or a desk to prevent the need for bending over or squatting down. However, the items in the conventional storage container may be heavy to be moved and inconvenient for the person to move or cause damage to surfaces it is placed on.

Therefore, another conventional storage container comprises stands to stand the conventional storage container off the ground and being foldable when the stands are not used. However, when the stands are folded, the stands are not flush attached to the body of the conventional storage container. Thus, the stands increase the storage volume of the conventional storage container.

To overcome the shortcomings, the present invention provides a storage container with retractable stands to mitigate or obviate the aforementioned problems.

SUMMARY OF THE INVENTION

The main objective of the present invention is to provide a storage container with retractable stands. The storage container with retractable stands has a body and two stand assemblies. The body has a front surface, a rear surface and multiple slots. The slots are formed in the front and rear surfaces. Each stand assembly has multiple props. Each prop is mounted pivotally in the corresponding slot. The props are pivoted to stand on the ground to stand the storage container off the ground for increased convenience. When the props are held in the slots, the props are completely received in the slots to avoid additional storage volume.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
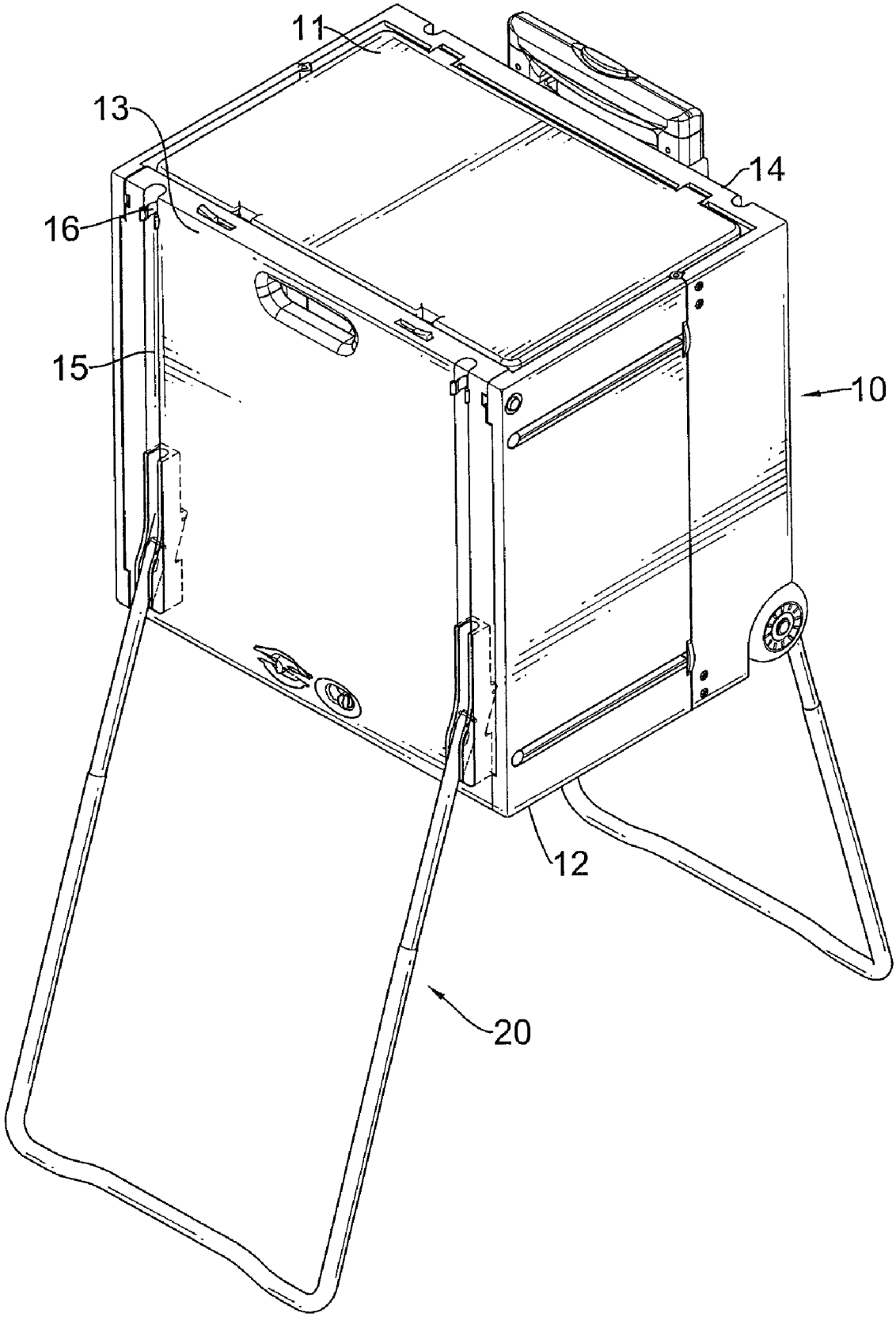
FIG. 1 is an operational perspective view of a storage container with retractable stands in accordance with the present invention.
Figure 2:
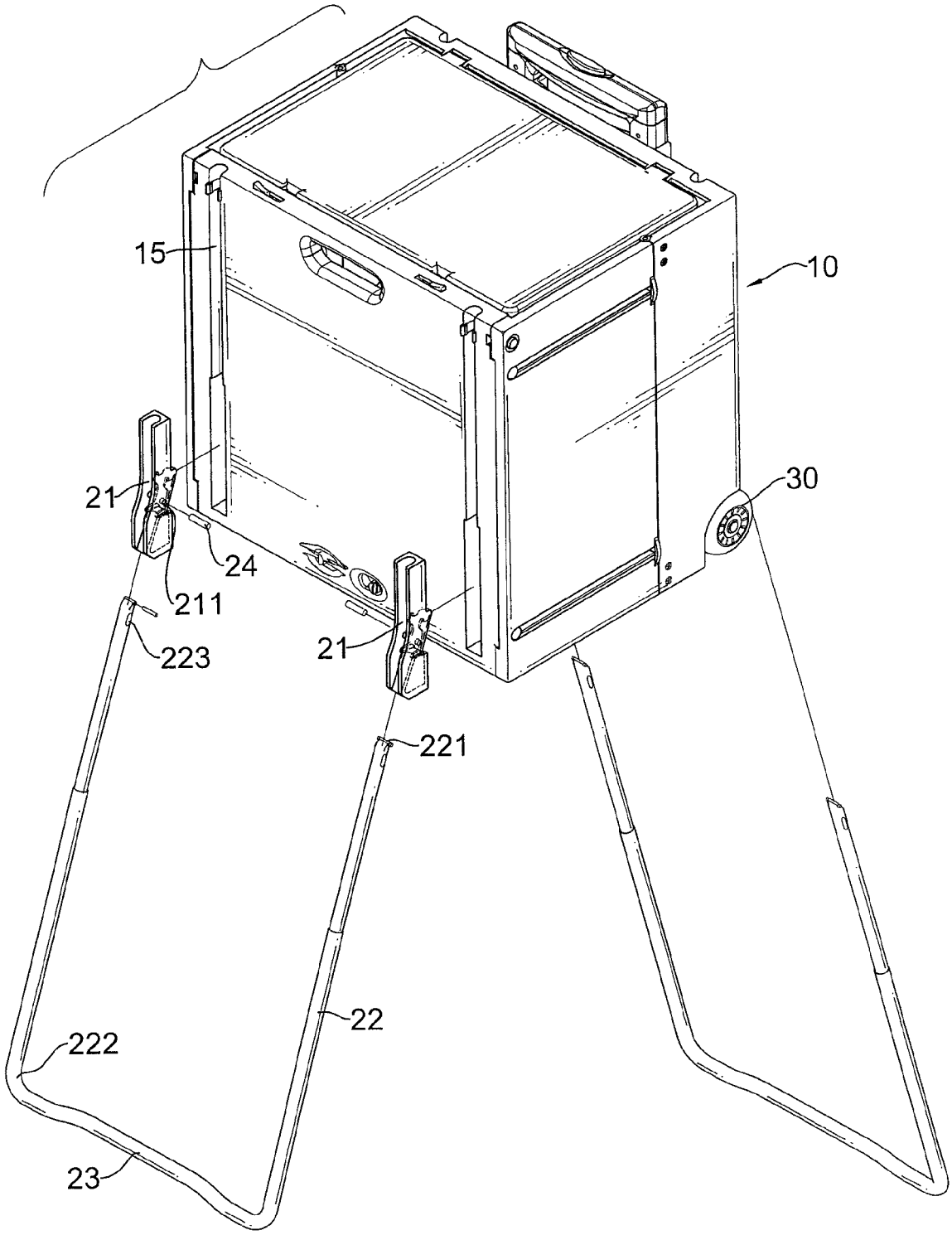
FIG. 2 is an exploded perspective view of the storage container in FIG. 1.
Figure 3:
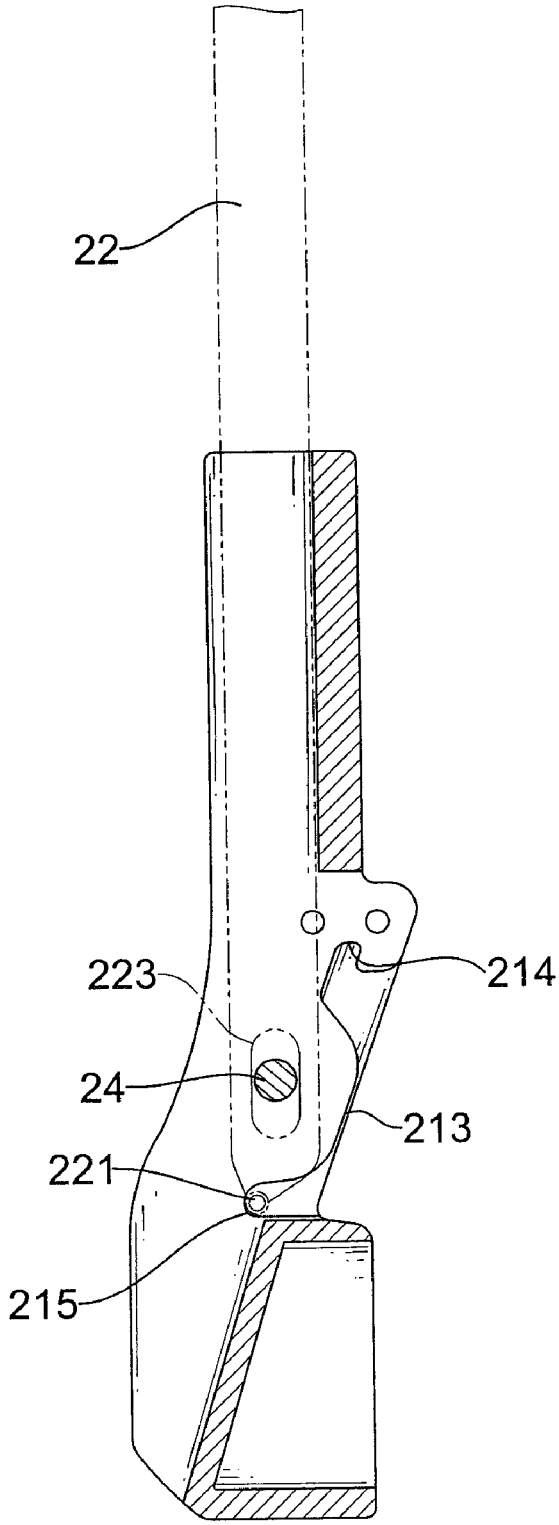
FIG. 3 is an enlarged side view in partial section of a bracket with a prop of the storage container in FIG. 1.
Figure 4:
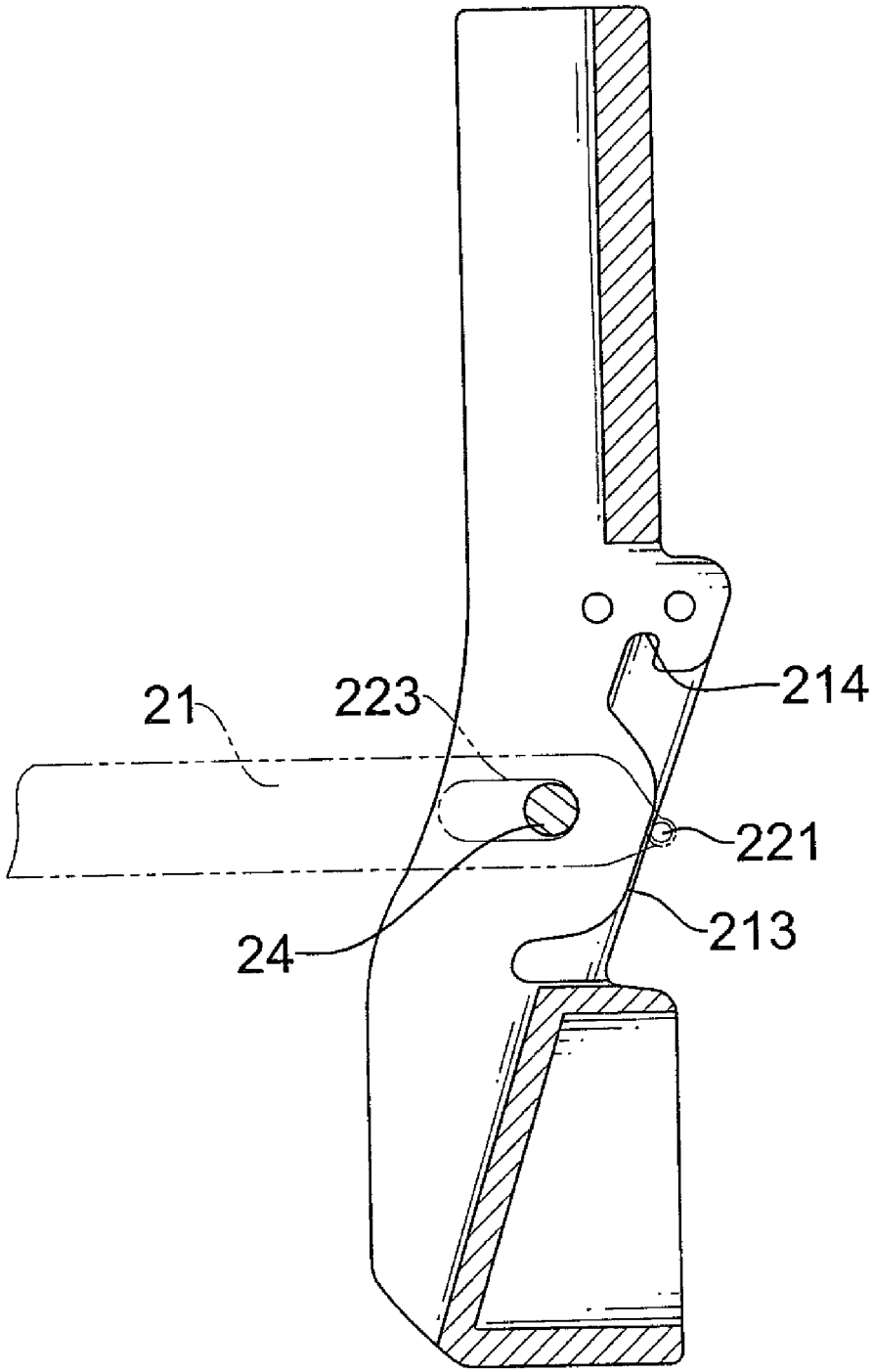
FIG. 4 is an enlarged operational side view in partial section of the bracket of the storage container in FIG. 1 with the prop pivoting.
Figure 5:
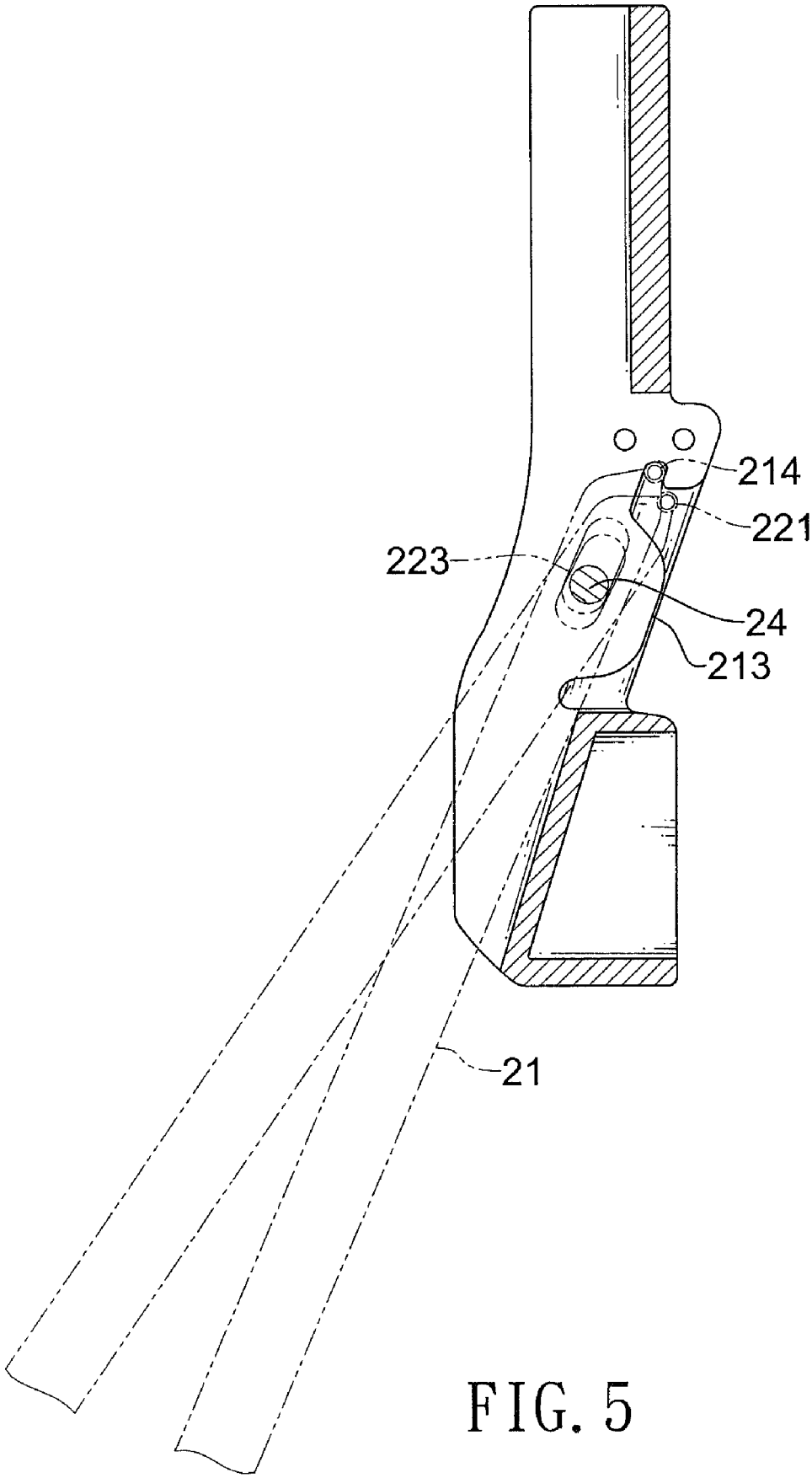
FIG. 5 is another enlarged operational side view in partial section of the bracket of the storage container in FIG. 1 with the prop pivoting and locking.

With reference to FIGS. 1 and 2, a storage container with retractable stands in accordance with the present invention comprises a body (10), two stand assemblies (20), two optional wheels (30, 30') and an optional telescopic frame (40).

The body (10) has a top (11), a bottom (12), a front surface (13), a rear surface (14), multiple slots (15) and multiple optional clips (16). In a preferred embodiment, the body (10) has four slots (15). The slots (15) are formed separately in the front and rear surfaces (13, 14), extend through the top (11) and have an inner width. In the preferred embodiment, two slots (15) are formed in each corresponding surface (13, 14). Each slot (15) may have an inner wall. The clips (16) are respectively mounted securely in the slots (15) near the top (11). Each clip (16) is attached securely to the inner wall of the corresponding slot (15).

Figure 8:
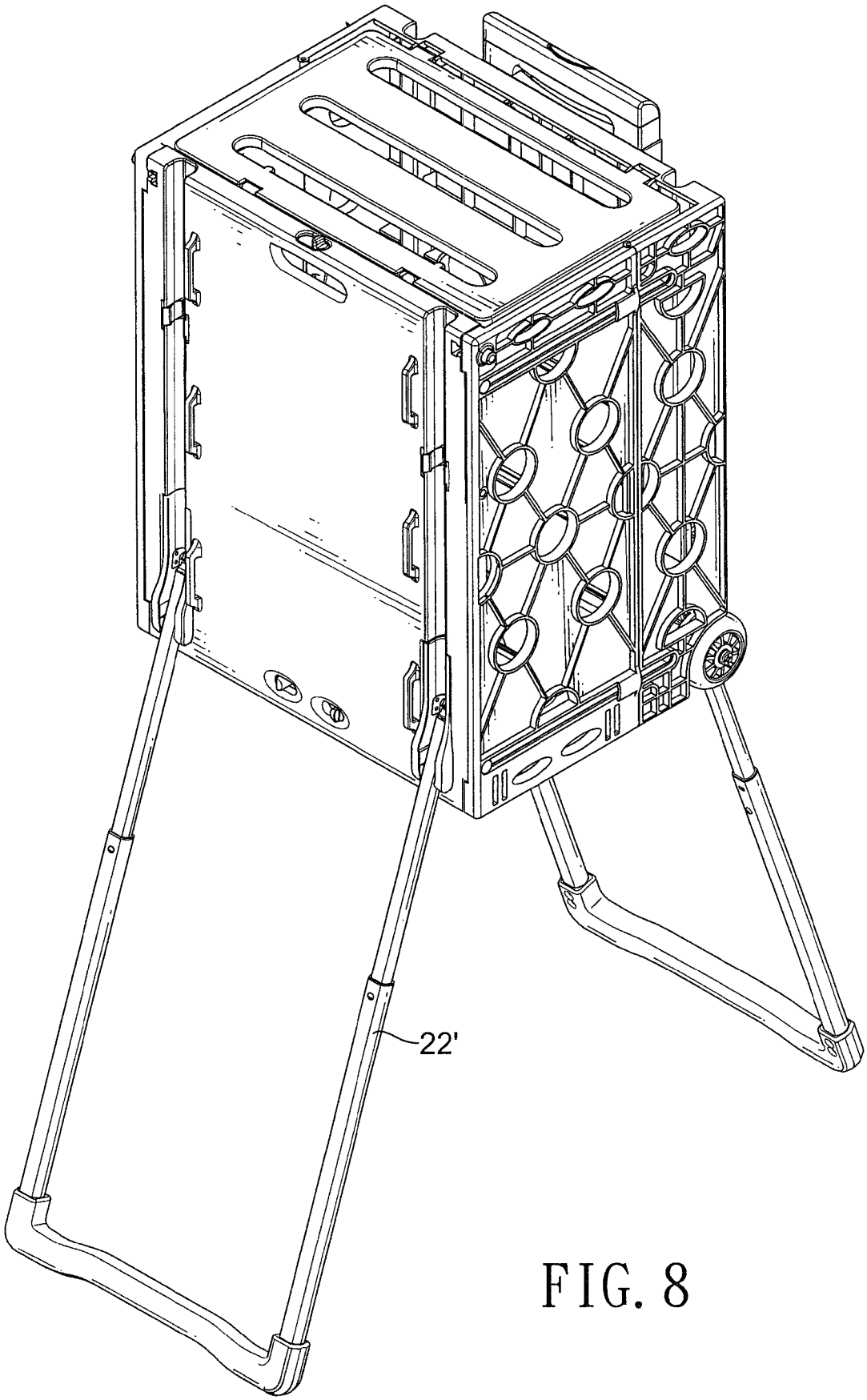
FIG. 8 is an operational perspective view of another embodiment of a storage container with retractable stands in accordance with the present invention.
Figure 9:
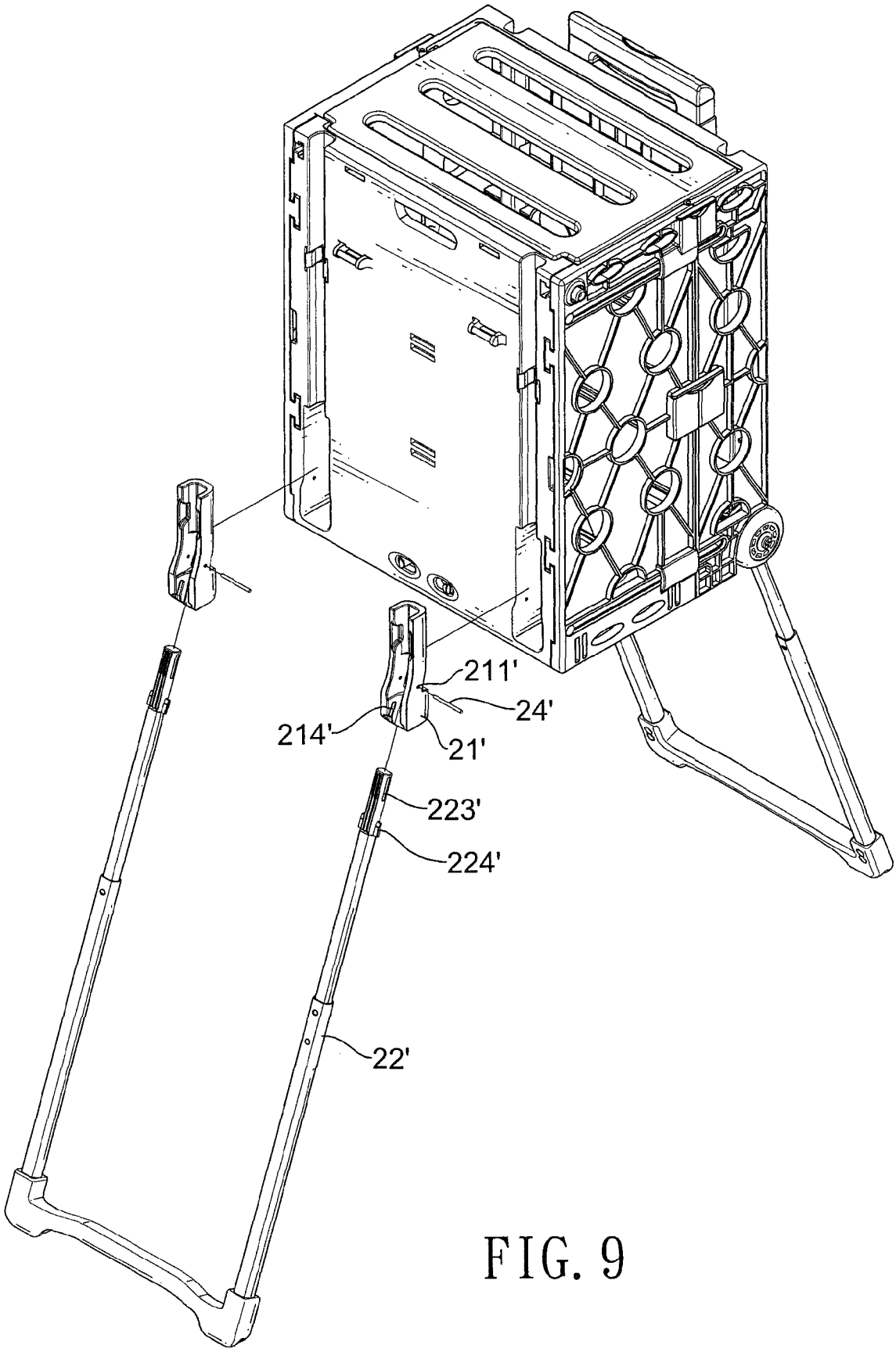
FIG. 9 is an exploded perspective view of the storage container in FIG. 8.
Figure 10:
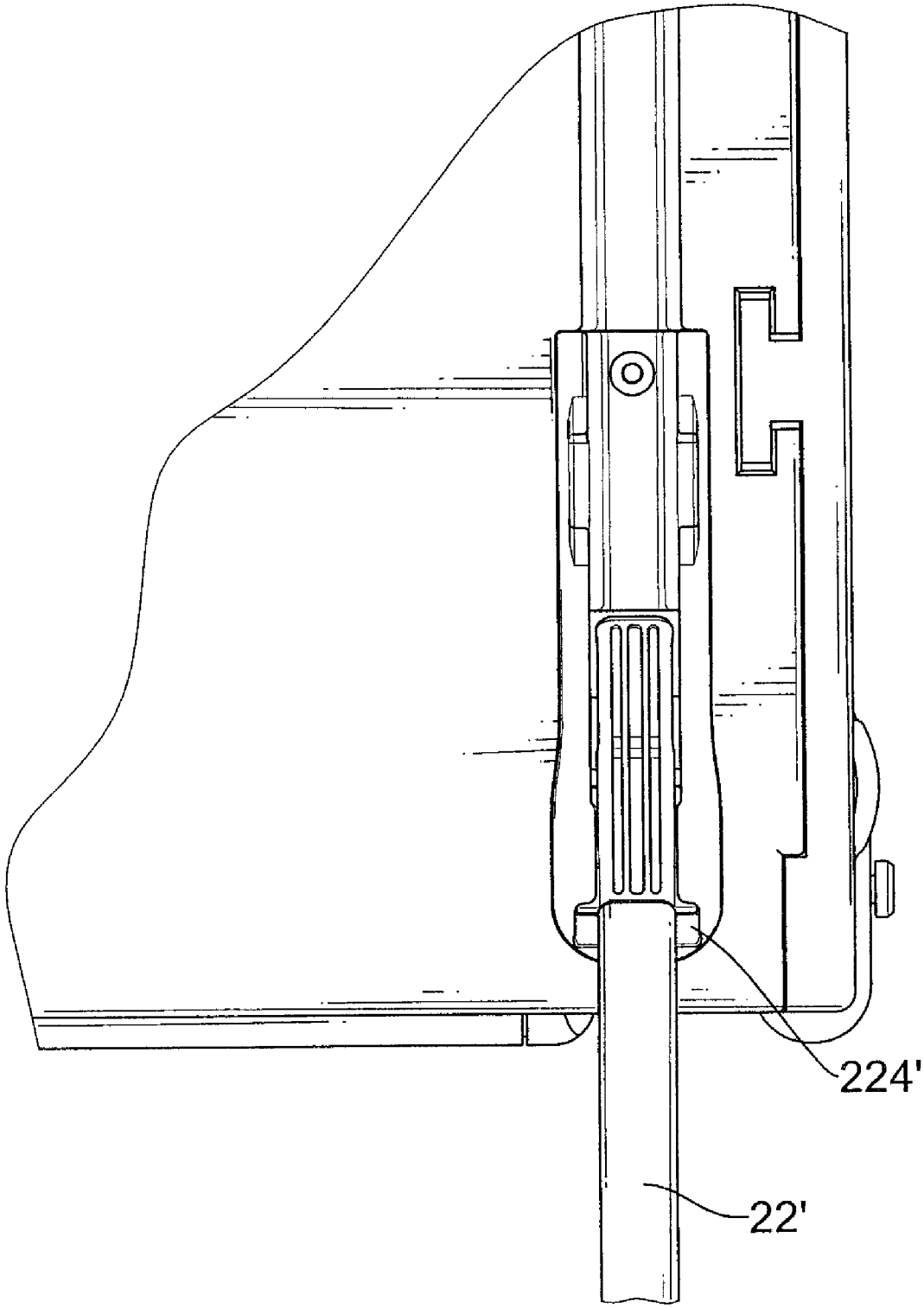
FIG. 10 is an enlarged partial front view of the storage container in FIG. 8.
Figure 11:
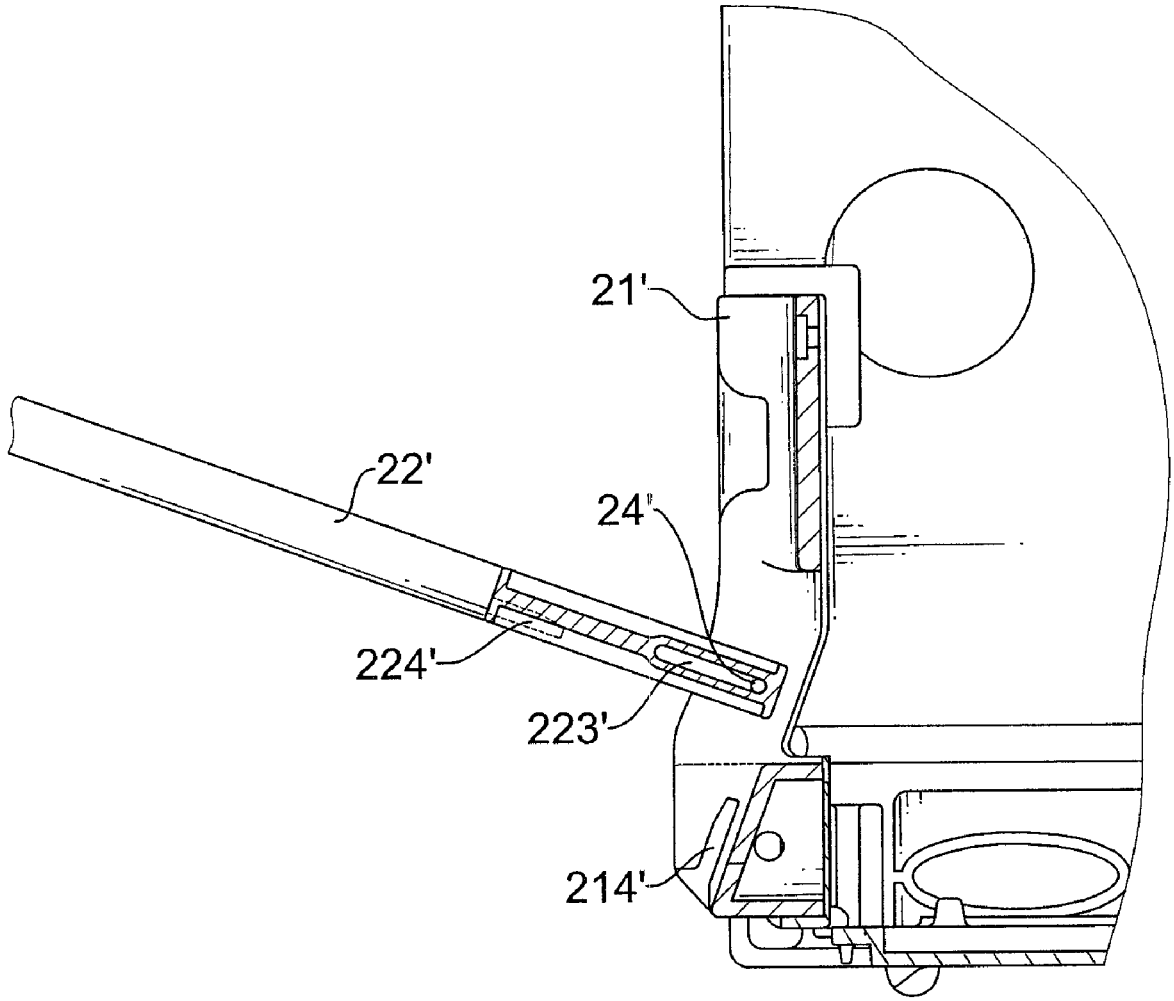
FIG. 11 is an enlarged operational partial side view of the storage container in FIG. 8.
Figure 12:
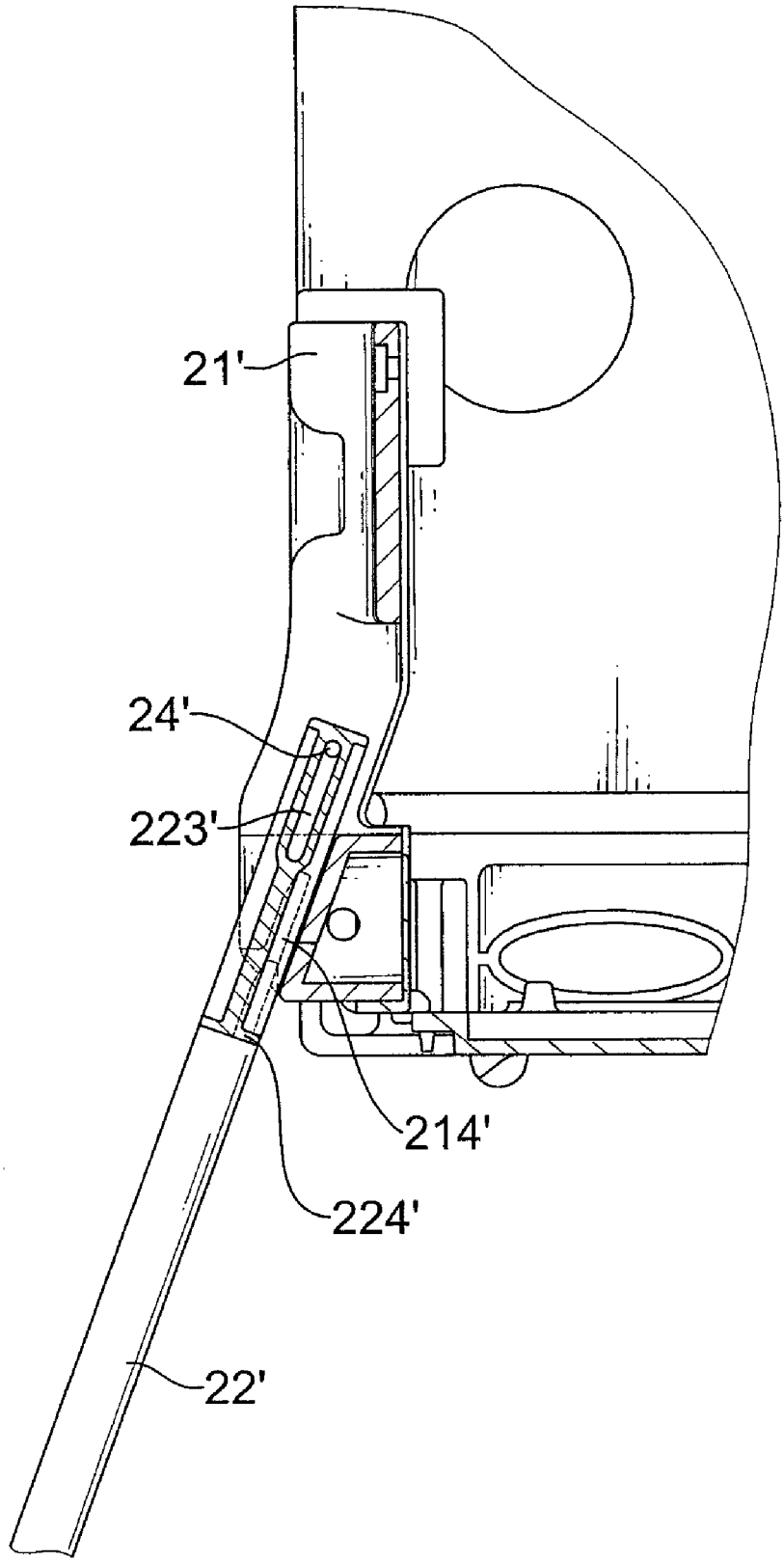
FIG. 12 is an enlarged operational partial side view of the storage container in FIG. 8.
Figure 13:
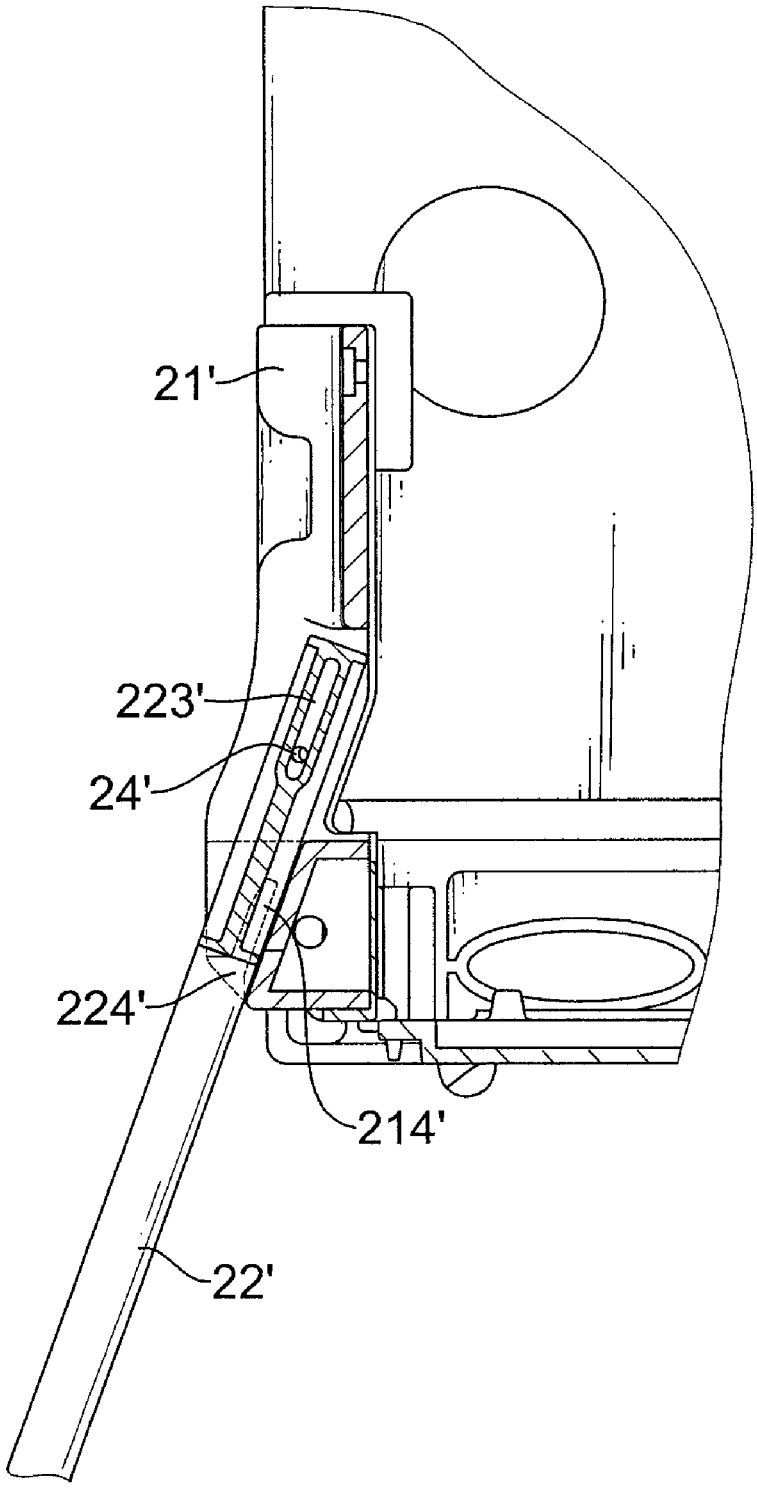
FIG. 13 is an enlarged operational partial side view of the storage container in FIG. 8.
Figure 14:
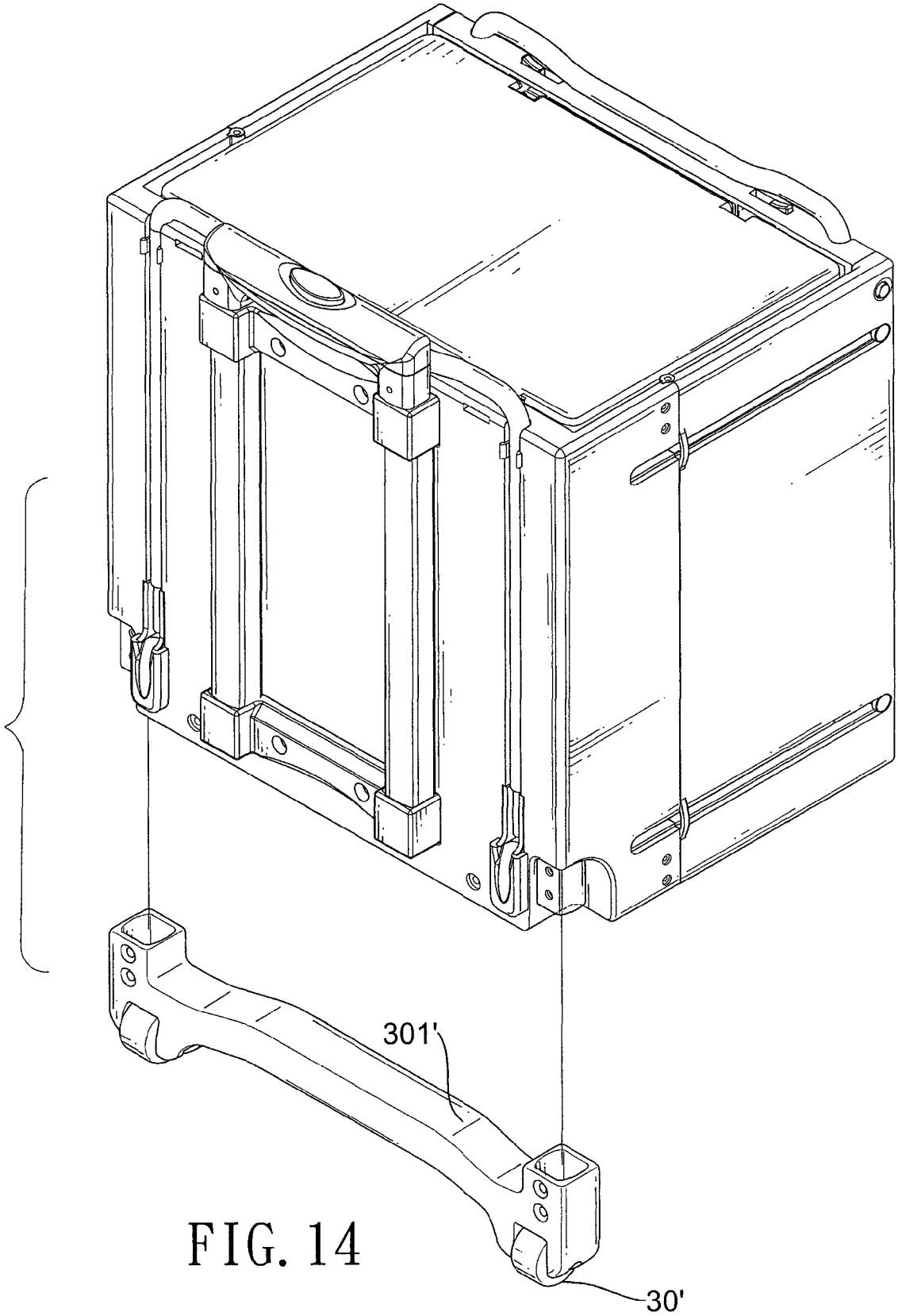
FIG. 14 is an exploded perspective view of still another embodiment of a storage container with retractable stands in accordance with the present invention.

With further reference to FIG. 8, the stand assemblies (20) respectively connect to the front and rear surfaces (13, 14) of the body (10). Each stand assembly (20) has multiple optional brackets (21, 21'), multiple props (22, 22'), multiple pivot pins (24) and an optional transverse brace (23). In the preferred embodiment, each stand assembly (20) has two brackets (21, 21') and two props (22, 22').

With further reference to FIGS. 3 to 5 and 9, the brackets (21, 21') are respectively mounted securely in the slots (15) near the bottom (12) of the body (10). Each bracket (21, 21') is attached securely to the inner wall of the corresponding slot (15) and has an open top, a closed bottom, a rear side, two sidewalls, two optional guiding edges (213), two pivot holes (211, 211'), an optional inclined surface (212) and two optional lock recesses (214'). The rear side faces to the corresponding slot (15). The guiding edges (213) are formed in the rear side of the bracket (21) and are formed respectively on the sidewalls of the bracket (21). Each guiding edge (213) has a top detent (214) and a bottom detent (215). The pivot holes (211, 211') are formed oppositely in the sidewalls near the open top and align with each other. The inclined surface (212) is formed adjacent to the closed bottom of the bracket (21). The lock recesses (214') are formed oppositely in the sidewalls, and each lock recess (214') has a bottom opening formed through the closed bottom and a side opening formed through the sidewall.

Figure 6:
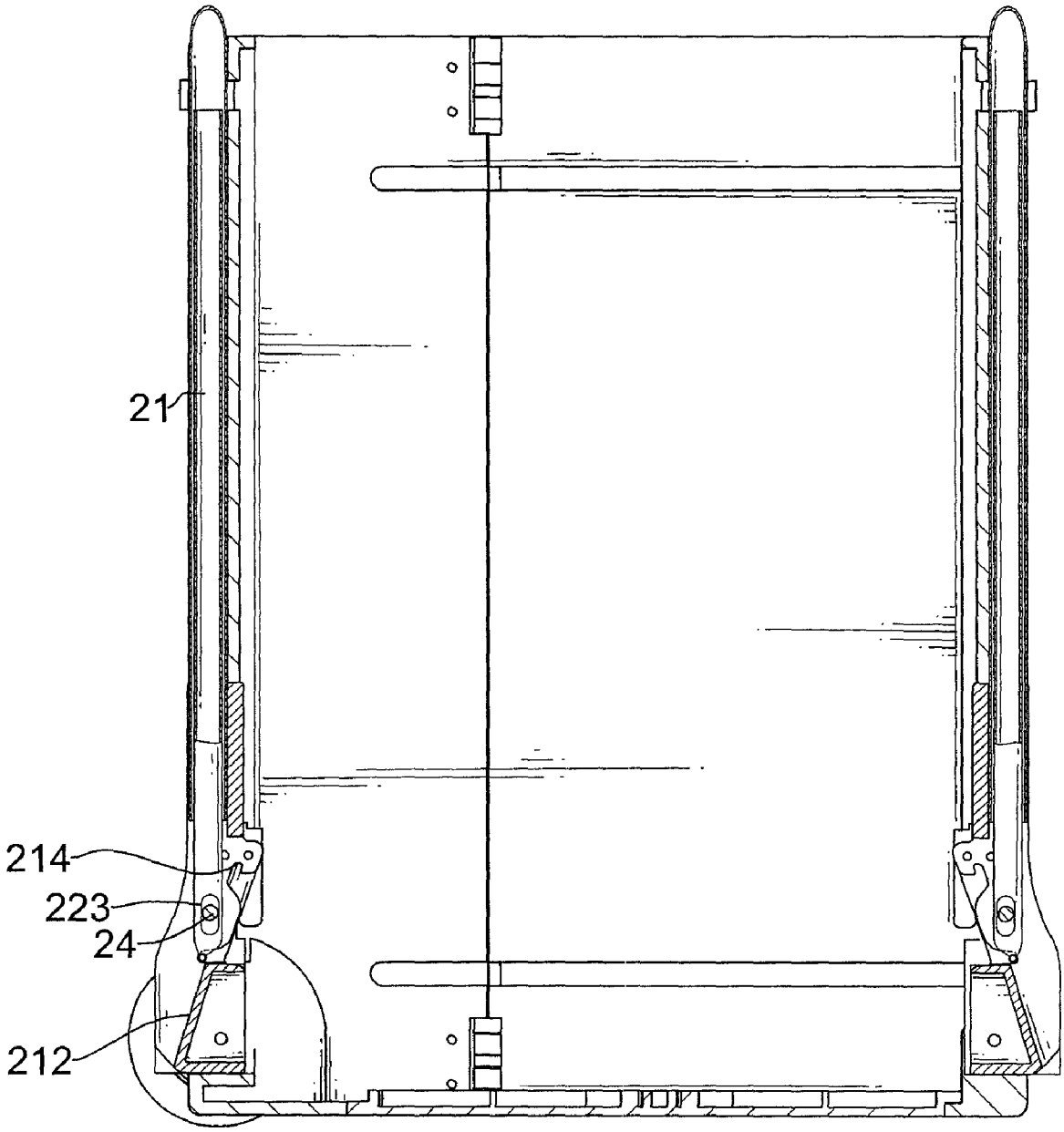
FIG. 6 is a side view in partial section of the storage container in FIG. 1 when the stand assemblies are retracted.
Figure 7:
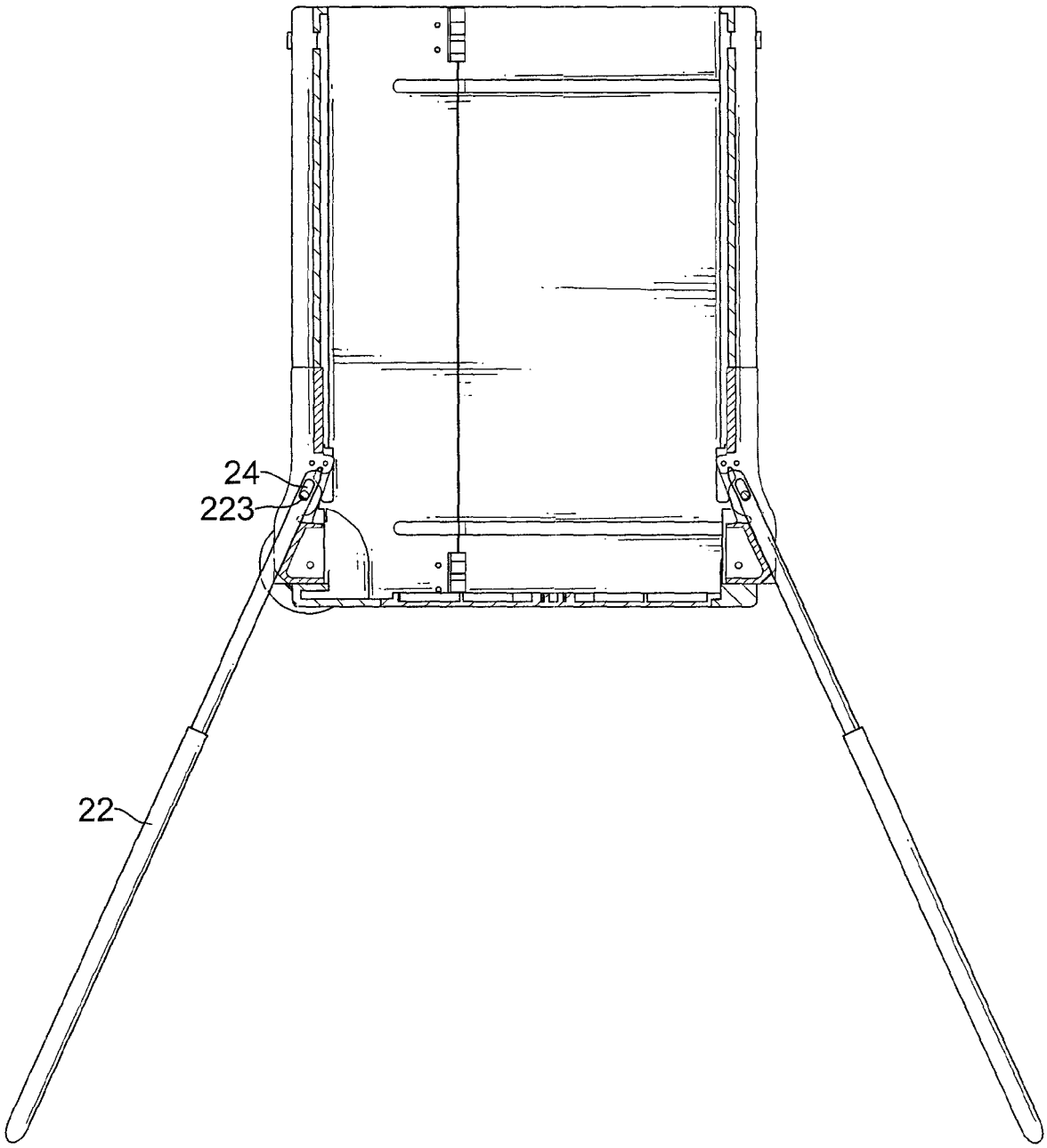
FIG. 7 is an operational side view in partial section of the storage container in FIG. 1.

With further reference to FIGS. 6 and 7, the props (22, 22') are selectively held in the slots (15), may be selectively held in the brackets (21, 21'), may be circular or quadrangular in cross section, may be telescopic, have a diameter, two sides, a pivot end (221) and a free end (222) and may have two pivot slots (223, 223') and two lock protrusions (224'). When the props (22, 22') are held in the slots (15), the props (22, 22') are completely received in the slots (15) to avoid additional storage volume. The diameter is smaller than the inner width of the slots (15). The pivot end (221) is connected pivotally to the corresponding slot (15), may be mounted pivotally in the corresponding bracket (21), may slide along the guiding edges (213) of the bracket (21) and may be held selectively in the top and bottom detents (214, 215). When the props (22) are pivoted down, the props (22) are pushed upward to hold the pivot ends (221) in the top detents (214) so the props (22) are held securely. The free end (222) may stand on the ground. The pivot slots (223, 223') are formed oppositely through the prop (22), align with each other and align with the pivot holes (211, 211') of the corresponding bracket (21, 21'). With further reference to FIGS. 10 to 13, the lock protrusions (224') are formed oppositely on the sides of the prop (22') near the pivot slots (223') and selectively engage in the lock recesses (214'). When the props (22') are pivoted down, the props (22') are pushed upward to slide in the bottom and side openings of the lock recesses (214') to engage the lock protrusions (224') in the lock recesses (214'). Therefore, the props (22') are held securely.

Each pivot pin (24, 24') extends through the pivot holes (211, 211') in the corresponding bracket (21, 21') and is mounted slidably in the pivot slots (223, 223') in the corresponding prop (22), and may allow the pivot end (221) of the prop (22) sliding along the guiding edges (213) of the bracket (21).

The brace (23) is formed perpendicularly between the free ends (222) of the corresponding props (22) to increase ease of use and provide a stable platform.

The wheels (30) are respectively mounted rotatably in the bottom (12) at the rear surface (14) of the body (10), or the wheel (30') are mounted rotatably on a wheel rod (301') mounted securely in the bottom (12) at the rear surface (14) of the body (10).

The telescopic frame (40) is mounted on the rear surface (14) of the body (10).

The advantage of the storage container with retractable stands as described is that the person simply pivots the props (22) down to stand the storage container off the ground for increased convenience. When the props (22, 22') are held in the slots (15), because the diameter of the props (22, 22') is smaller than the inner width of the slots (15), the props (22, 22') are completely received in the slots (15) to avoid additional storage volume.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A storage container with retractable stands comprising:

a body having a top;

a bottom;

a front surface;

a rear surface; and multiple slots formed separately in the front and rear surfaces extending through the top and each slot has an inner width; and two stand assemblies respectively connecting to the front and rear surfaces of the body, and each stand assembly having multiple brackets respectively mounted securely in the slots near the bottom of the body, and each bracket has an open top and a closed bottom; and multiple props respectively connected pivotally to and selectively held in the slots in the body, and each prop having a diameter being smaller than the inner width of a corresponding slot;

a free end; and a pivot end mounted pivotally in a corresponding bracket.

2. The storage container as claimed in claim 1, wherein each stand assembly has a brace formed perpendicularly between the free ends of the corresponding props.

3. The storage container as claimed in claim 1, wherein each bracket has a rear side facing to a corresponding slot;

two sidewalls;

two guiding edges formed in the rear side of the bracket and formed respectively on the sidewalls of the bracket, and each guiding edge having a top detent and a bottom detent; and two pivot holes formed oppositely in the sidewalls near the open top and aligning with each other;

each prop has two pivot slots formed oppositely through the prop, aligning with each other and aligning with the pivot holes of the corresponding bracket; and each stand assembly further has multiple pivot pins, and each pivot pin extending through the pivot holes in a corresponding bracket and mounted slidably in the pivot slots in a corresponding prop.

4. The storage container as claimed in claim 2, wherein each bracket has a rear side facing to a corresponding slot;

two sidewalls;

two guiding edges formed in the rear side of the bracket and formed respectively on the sidewalls of the bracket, and each guiding edge having a top detent and a bottom detent; and two pivot holes formed oppositely in the sidewalls near the open top and aligning with each other;

each prop has two pivot slots formed oppositely through the prop, aligning with each other and aligning with the pivot holes of the corresponding bracket; and each stand assembly further has multiple pivot pins, and each pivot pin extending through the pivot holes in a corresponding bracket and mounted slidably in the pivot slots in a corresponding prop.

5. The storage container as claimed in claim 1, wherein each bracket has two sidewalls;

two pivot holes formed oppositely in the sidewalls near the open top and aligning with each other; and two lock recesses formed oppositely in sidewalls, and each lock recess having a bottom opening formed through the closed bottom and a side opening each prop has two pivot slots formed oppositely through the prop, aligning with each other and aligning with the pivot holes of the corresponding bracket; and two lock protrusions formed oppositely on the sides of the prop near the pivot slots and selectively engaging in the lock recesses; and each stand assembly further has multiple pivot pins, and each pivot pin extending through the pivot holes in a corresponding bracket and mounted slidably in the pivot slots in a corresponding prop.

6. The storage container as claimed in claim 1, wherein each bracket has an inclined surface formed adjacent to the closed bottom of the bracket; and each prop selectively abuts the inclined surface of the corresponding bracket.

7. The storage container as claimed in claim 4, wherein each bracket has an inclined surface formed adjacent to the closed bottom of the bracket; and each prop selectively abuts the inclined surface of the corresponding bracket.

8. The storage container as claimed in claim 5, wherein each bracket has an inclined surface formed adjacent to the closed bottom of the bracket; and each prop selectively abuts the inclined surface of the corresponding bracket.

9. The storage container as claimed in claim 1, wherein each slot has an inner wall;

the body has multiple clips, each clip attached securely to the inner wall of a corresponding slot; and the props are held selectively by the clips.

10. The storage container as claimed in claim 7, wherein each slot has an inner wall;

the body has multiple clips, each clip attached securely to the inner wall of a corresponding slot;

each bracket is attached securely to the inner wall of a corresponding slot; and the props are held selectively by the clips.

11. The storage container as claimed in claim 8, wherein each bracket has an inclined surface formed adjacent to the closed bottom of the bracket; and each prop selectively abuts the inclined surface of the corresponding bracket.

12. The storage container as claimed in claim 1, wherein each prop is telescopic.

13. The storage container as claimed in claim 1, wherein each prop is circular in cross section.

14. The storage container as claimed in claim 1, wherein each prop is quadrangular in cross section.

15. The storage container as claimed in claim 1 further comprising two wheels respectively mounted rotatably in the bottom at the rear surface of the body.

16. The storage container as claimed in claim 1 further comprising a wheel rod mounted securely in the bottom at the rear surface of the body; and two wheels mounted rotatably on the wheel rod.

17. The storage container as claimed in claim 1 further comprising a telescopic frame mounted on the rear surface of the body.

* * * * *